US006354546B1

(12) United States Patent
Mueller

(10) Patent No.: US 6,354,546 B1
(45) Date of Patent: Mar. 12, 2002

(54) RETAIL SIGN HOLDER

(75) Inventor: Paul A. Mueller, Wadsworth, OH (US)

(73) Assignee: Fasteners For Retail, Inc., Cleveland, OH (US)

( * ) Notice: Subject to any disclaimer, the term of this patent is extended or adjusted under 35 U.S.C. 154(b) by 0 days.

(21) Appl. No.: 09/507,957

(22) Filed: Feb. 22, 2000

Related U.S. Application Data

(63) Continuation-in-part of application No. 09/078,164, filed on May 13, 1998.

(51) Int. Cl.[7] ..... A47B 96/00

(52) U.S. Cl. ..... 248/220.42; 248/220.41; 248/479; 40/649; 40/642.01; 40/642.02; 40/657

(58) Field of Search ..... 248/220.42, 220.21, 248/479; 40/649, 642.01, 642.02, 657

(56) References Cited

U.S. PATENT DOCUMENTS

| | | | | |
|---|---|---|---|---|
| 3,525,493 A | | 8/1970 | Chrietzberg et al. | |
| 4,512,095 A | * | 4/1985 | Seely | 40/156 |
| 4,798,014 A | * | 1/1989 | Stoerzinger et al. | 40/124.1 |
| 4,805,331 A | * | 2/1989 | Boggess et al. | 40/651 |
| 4,881,707 A | * | 11/1989 | Garfinkle | 248/221.4 |
| 4,909,464 A | * | 3/1990 | Levine et al. | 248/225.1 |
| 4,995,182 A | | 2/1991 | Fast | |
| 5,086,958 A | | 2/1992 | Nagy | |
| 5,233,773 A | * | 8/1993 | Reynolds | 40/642 |
| 5,381,908 A | * | 1/1995 | Hepp | 211/184 |
| 5,664,749 A | * | 9/1997 | Kump et al. | 248/220.22 |
| 5,683,003 A | | 11/1997 | Gebka | |
| 5,771,619 A | * | 6/1998 | Wells | 40/643 |
| 5,832,644 A | * | 11/1998 | Mason | 40/642.02 |
| 5,921,011 A | * | 7/1999 | Hawver | 40/212 |
| 6,082,687 A | * | 7/2000 | Kump et al. | 248/220.41 |
| 6,202,334 B1 | * | 3/2001 | Reynolds et al. | 40/642.02 |

OTHER PUBLICATIONS

Fasteners For Retail 1997 Buyers Guide—Our Experience Is On Display, Cover Page, pp. 8, 9, 11, 22, 23, 25, 26, 27 and 28.

* cited by examiner

*Primary Examiner*—Anita King
*Assistant Examiner*—Steven M. Marsh
(74) *Attorney, Agent, or Firm*—Fay, Sharpe, Fagan, Minnich & McKee, LLP

(57) ABSTRACT

A sign holder assembly for holding signs for displaying prices and other information on merchandise display racks, shelves and peg hooks includes a base, a support member and a holder body for selectively accommodating a sign. The holder body is pivotable in relation to the base via a hinge located in the support member. In one embodiment, the base includes a resilient fastener and, spaced therefrom, a finger which are both secured to the bottom surface of the base. The resilient fastener and the finger engage a wall surface adjacent a respective hole in a display rack or shelf. In another embodiment, the base can be mounted on a peg hook. The holder body can include a bottom wall, a pair of side walls and a top wall which together define a frame-like element. These walls cooperate to form a socket allowing a sign to be selectively secured within the holder body.

19 Claims, 8 Drawing Sheets

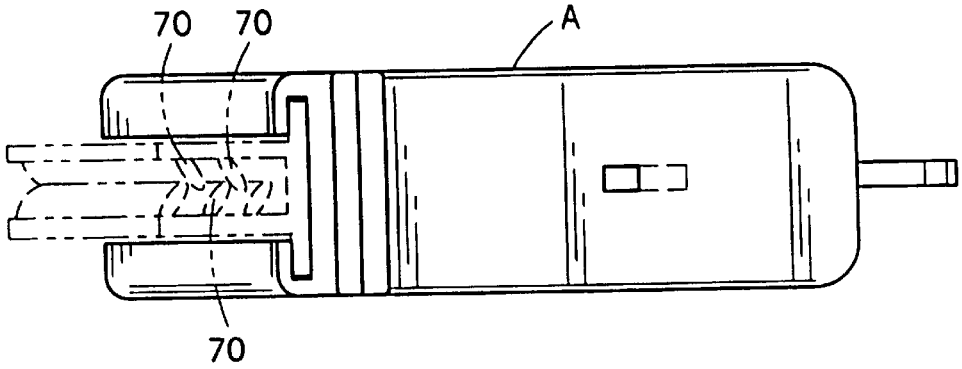
FIG.2
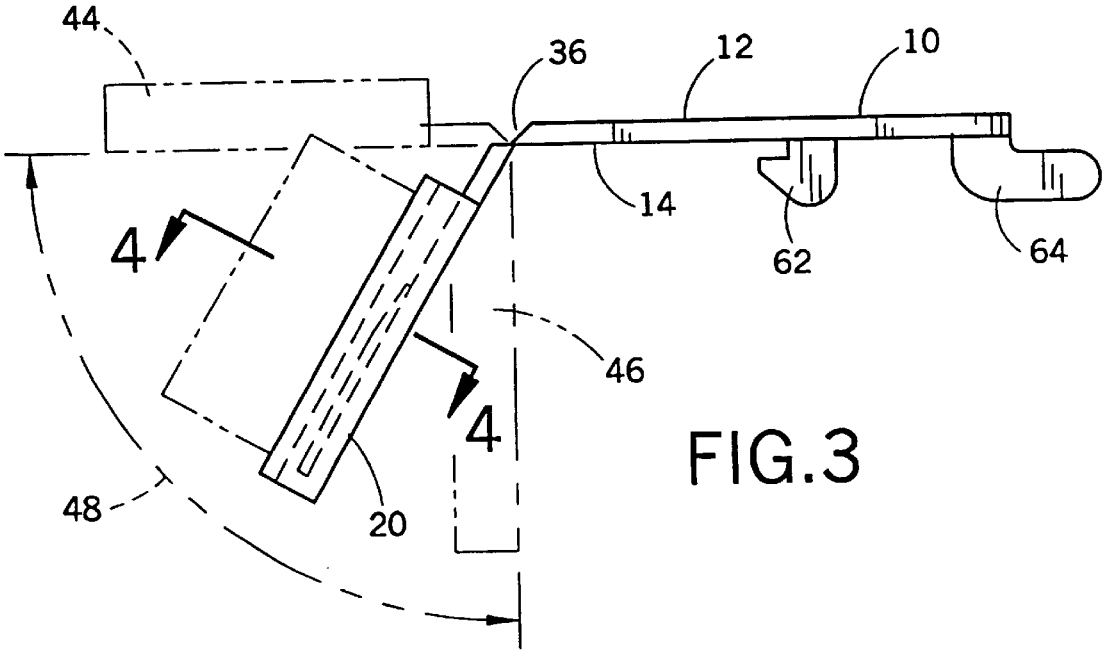
FIG.3
FIG.4
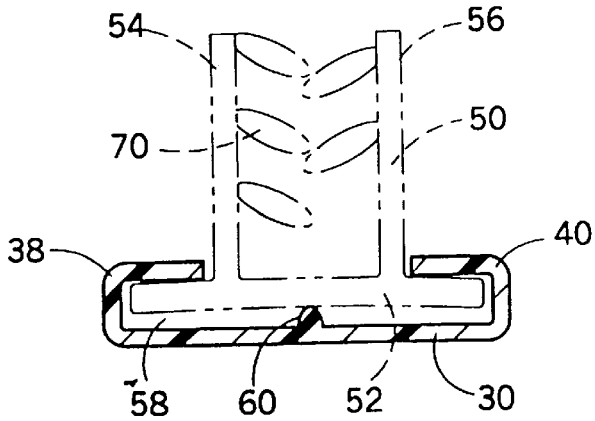

RETAIL SIGN HOLDER

This application is a continuation-in-part of application Ser. No. 09/078,164, which was filed on May 13, 1998 and is still pending.

BACKGROUND OF THE INVENTION

The present invention relates generally to point of purchase sign holders which display signs in a flag-like orientation. These are known in the industry as flag holders. More particularly, it relates to improved flag holders for use with display racks, shelves and other product carrying structures employed in retail stores for displaying merchandise. The holders enable signs or labels with prices and other information to be prominently displayed adjacent the merchandise held on product carrying structures such as shelves or peg hooks.

Businesses use a wide variety of devices to display products and sale prices to consumers. One of the known ways to display products in a retail environment involves the use of horizontally oriented display shelves. Another known way of displaying products is by mounting packages from hooks secured on a pegboard. Often in displaying products on shelves, it is difficult to prominently display sale tags or price signs due to a lack of space at the front edge of a shelf or display rack. This problem is exacerbated in the case of peg hooks where a small label holder is the only display surface available. As a result, it is desirable to provide a flag holder which is mounted on a shelf or display rack or on a peg hook for easy visibility of a sign by a consumer and which allows the sign to be readily attached to or removed from the shelf or display rack, or from a peg hook.

Price tag display hangers and label holders used in merchandising displays have been common for some time. One known device is shown in U.S. Pat. No. 5,683,003. This device is a label holder with a transparent label cover which enables the label holder to carry adhesive or non-adhesive labels. The device further includes a foot and post mounting to provide cantilever support for the device. A disadvantage of this device is that the label is not easily removable. The label cover must be removed in order to allow removal of a label. Another disadvantage of this device is that the size of labels to be displayed is limited by the size of the label cover. Also, the foot and post mounting arrangement is disadvantageous from the standpoint that it allows the front end of the device to be tipped up, making possible an inadvertent disengagement of the device from the shelf it is attached to.

Accordingly, it has been considered desirable to develop new and improved sign holders, such as flag holders and label holders which would overcome the foregoing difficulties and others while providing better and more advantageous overall results.

BRIEF SUMMARY OF THE INVENTION

The present invention relates to a sign holder for use with a product carrying structure for displaying retail products and merchandise. The sign holder can display prices, etc. to consumers.

More specifically, the sign holder may be attached to a display rack, a shelf or a peg hook and used to display signs. The signs may list prices, product information, the existence of a sale on the product, etc. The signs are preferably displayed in a flag orientation for viewing from the side.

In one preferred embodiment, a sign holder assembly comprises a base, a support member, and a holder. The base is comprised of a top surface, a bottom surface, and first and second ends. The support member comprises a planar body having a first end connected to the base and a second end connected to the holder. The holder includes a bottom wall, and first and second side walls which are spaced apart and extend from the bottom wall.

If desired, the holder can be pivotable in relation to the base via a hinge located on the support member. The base, the support member and the holder can be of one piece and made of a plastic material.

The base can further include a resilient fastener which is secured to the bottom surface of the base. The resilient fastener engages a wall surface adjacent a hole in a display rack or shelf.

The base can further include a finger which extends from the bottom surface of the base. The finger also engages a wall surface adjacent a hole in a display rack or shelf. The finger is spaced from the resilient fastener. Preferably, the finger and the resilient fastener are aligned along the longitudinal axis of the base.

If desired, the holder can further include a slotted top wall which is connected to the first and second side walls. The slot in the top wall accommodates a sign which can be selectively mounted in the holder.

One advantage of the present invention is the provision of a new and improved sign holder assembly having a base, a support member and a holder body. The holder selectively accommodates a sign.

Another advantage of the present invention is the provision of a sign holder assembly having a variety of bases, a common support member, which includes a hinge, and a common holder body which forms a socket for selectively accommodating a sign.

Still another advantage of the present invention is the provision of a sign holder assembly in which a sign holder body is pivotable in a vertical plane via a hinge between a first orientation, approximately normal to a shelf front surface and a second orientation approximately parallel to the shelf front surface.

Yet another advantage of the present invention is the provision of a sign holder assembly with a base which includes a resilient fastener and a finger, secured to the bottom surface of the base and spaced from each other. These two elements engage a wall surface adjacent a pair of spaced holes in a display rack to resist a removal of the base from the display rack by jostling.

Still yet another advantage of the present invention is the provision of a sign holder assembly which is of unitary construction and includes a base and a holder body which extends approximately normal to the base. The holder body is frame-like and includes pairs of spaced walls which define between them slots for selectively accommodating the edges of a sign.

A further advantage of the present invention is the provision of sign holder assembly including a frame-like holder having a slotted top wall through which a sign can be installed and removed.

A still further advantage of the present invention is the provision of a sign holder assembly of unitary construction including a base, a support member and a frame-like sign holder. The base is adapted for mounting on a peg hook by cooperating with both a support leg for the label plate of the peg hook and the label plate itself.

Still other benefits and advantages of the present invention will become apparent to those skilled in the art upon a reading and understanding of the following detailed specification.

BRIEF DESCRIPTION OF THE DRAWINGS

The invention will take form in certain parts and arrangements of parts, preferred embodiments of which will be described in detail in this specification and illustrated in the accompanying drawings which form a part hereof and wherein:

FIG. 2 is a top elevational view of the flag holder assembly of FIG. 1 in the assembled configuration;

FIG. 3 is a side elevational view of the flag holder assembly of FIG. 2 showing the pivoting of the holder and support member with respect to the base;

FIG. 4 is a cross-sectional view of the flag holder assembly of FIG. 3, along line 4—4;

DETAILED DESCRIPTION OF THE PREFERRED EMBODIMENTS

Figure 5:
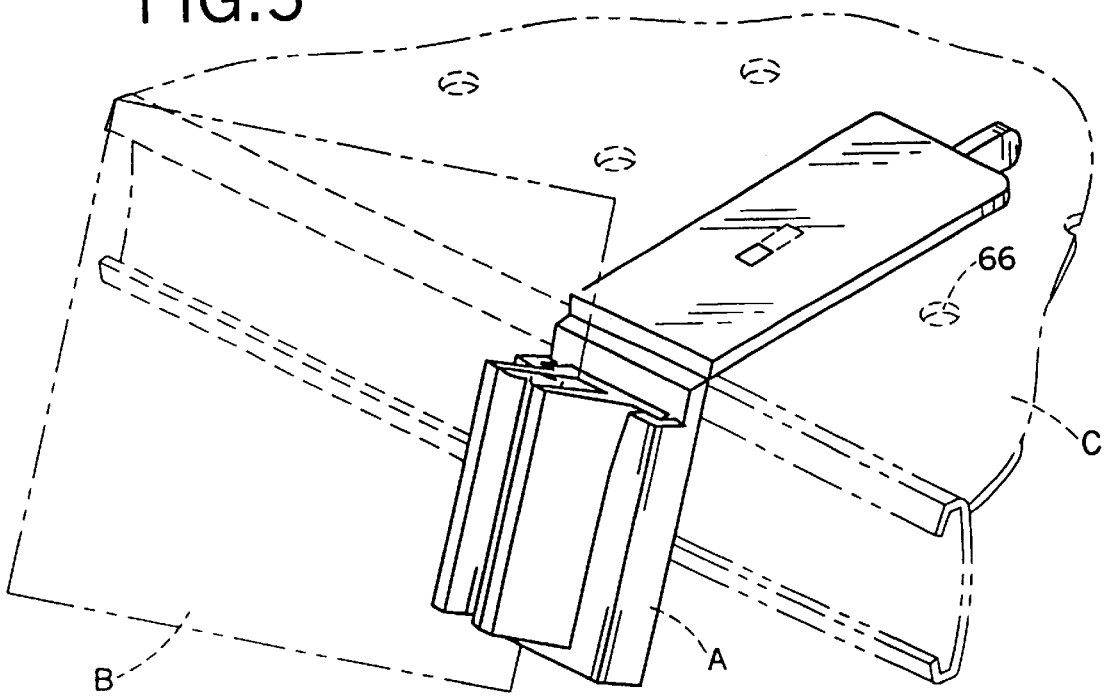
FIG. 5 is a perspective view of the flag holder assembly of FIG. 1 in the assembled configuration when attached to a display shelf and holding a sign.

Referring now to the drawings, wherein the showings are for purposes of illustrating preferred embodiments of this invention only and not for purposes of limiting same, FIG. 2 shows a flag holder assembly A according to a first preferred embodiment of the present invention. As shown in FIG. 5, the flag holder assembly A can be used to hold a sign B for displaying prices, product information, the existence of a sale, etc. to consumers in merchandise and retail product displays. The flag holder assembly A is attached to a display rack or shelf C so that the sign 13 protrudes in front of the shelf.

Figure 1:
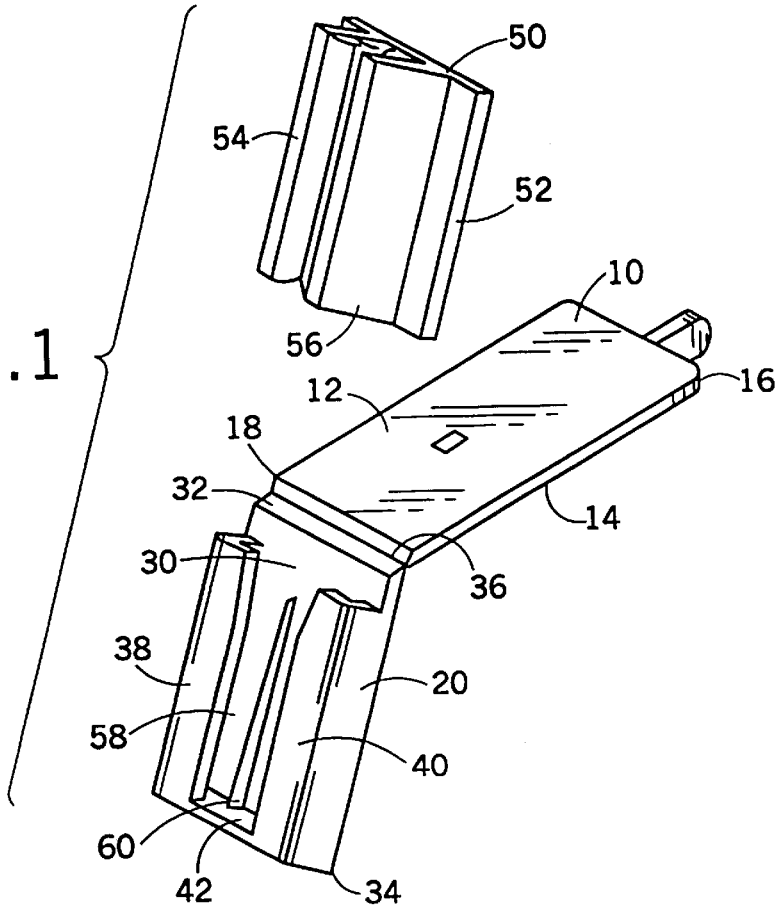
FIG. 1 is an exploded perspective view of a flag holder assembly in accordance with a first preferred embodiment of the present invention.

Referring now to FIG. 1, the flag holder assembly includes a base 10, which has a top surface 12, a bottom surface 14, a first end 16 and a second end 18. The flag holder assembly also includes a support member 20. The support member 20 includes a planar body 30 which has a first end 32 and a second end 34. The planar body 30 is connected to the base 10 by a hinge 36. The hinge 36 extends between the second end 18 of the base 10 and the first end 32 of the planar body 30.

The base 10 and support member 20 are preferably made of one piece and are fabricated from a resilient material, preferably a thermoplastic, such as injection molded natural polypropylene.

The support member 20 further includes a pair of L-shaped walls 38, 40 which are oriented so as to face each other. The L-shaped walls 38, 40 extend upwardly from opposed side edges of the planar body 30. The support member 20 also includes an end wall 42 which protrudes upwardly from the second end 34 of the planar body 30 in a direction perpendicular to the longitudinal axes of the pair of L-shaped walls 38, 40.

Referring now to FIG. 3, the support member 20 can be pivoted in relation to the base 10 via the hinge 36 between a horizontal orientation 44 approximately parallel to the base 10 to a vertical orientation 46 approximately normal to the base 10, as shown by the arrow 48.

Referring again to FIG. 1, the flag holder assembly A also includes a holder 50 which is used to selectively accommodate the sign B. The holder 50 includes a back wall 52, a first wall 54 and a second wall 56. The first wall 54 and the second wall 56 are parallel to each other and are spaced apart. They protrude from the back wall 52. The holder 50 is accommodated by a socket 58 formed by the pair of L-shaped walls 38, 40 and the end wall 42 of the support member 20.

If desired, the support member 20 can further include a rib 60 which extends from the planar body 30 and is positioned between the pair of L-shaped walls 38, 40. The rib 60 is wedge-shaped and has a thin end located near the opening in the socket 58 and a thick end located adjacent the end wall 42. Referring now to FIG. 4, the holder 50 engages the rib 60 and the walls forming the socket 58. The rib 60 pushes the holder 50 against the L-shaped walls 38, 40 to frictionally engage the holder 50 and retard its removal from the socket 58.

Referring again to FIG. 3, the base 10 can further include a resilient fastener in the form of hook 62 and, spaced therefrom, a finger 64 which both extend from the bottom surface 14 of the base 10. The finger 64 extends rearwardly from the base 10. Referring now to FIG. 5, the hook 62 and the finger 64 each engage a wall surface adjacent a hole 66 in the display rack or shelf C. It is apparent from FIG. 2 that the hook 62 and finger 64 are aligned on the longitudinal centerline of the base 10. The hook 62 is advantageous from the standpoint that it positively locks the base 10 to the shelf C shown in FIG. 5 to retard its removal from the shelf when the assembly A is inadvertently bumped by a shopper passing by the shelf.

If desired, with reference now to FIG. 2 and FIG. 4, the holder 50 can include one or more fins 70 which extend from inside surfaces of the first and second walls 54, 56 of the holder 50. The fins 70 can be inwardly angled and preferably overlap each other to firmly secure the sign B in the holder 50 and retard its removal.

Preferably, the holder 50 is made from a co-extended plastic material. Preferably, the fins 70 are made of a more resilient thermoplastic and the back, first, and second walls 52, 54, 56 are made of a more rigid thermoplastic. In one embodiment, the thermoplastic is a clear polyvinylchloride.

Figure 6:
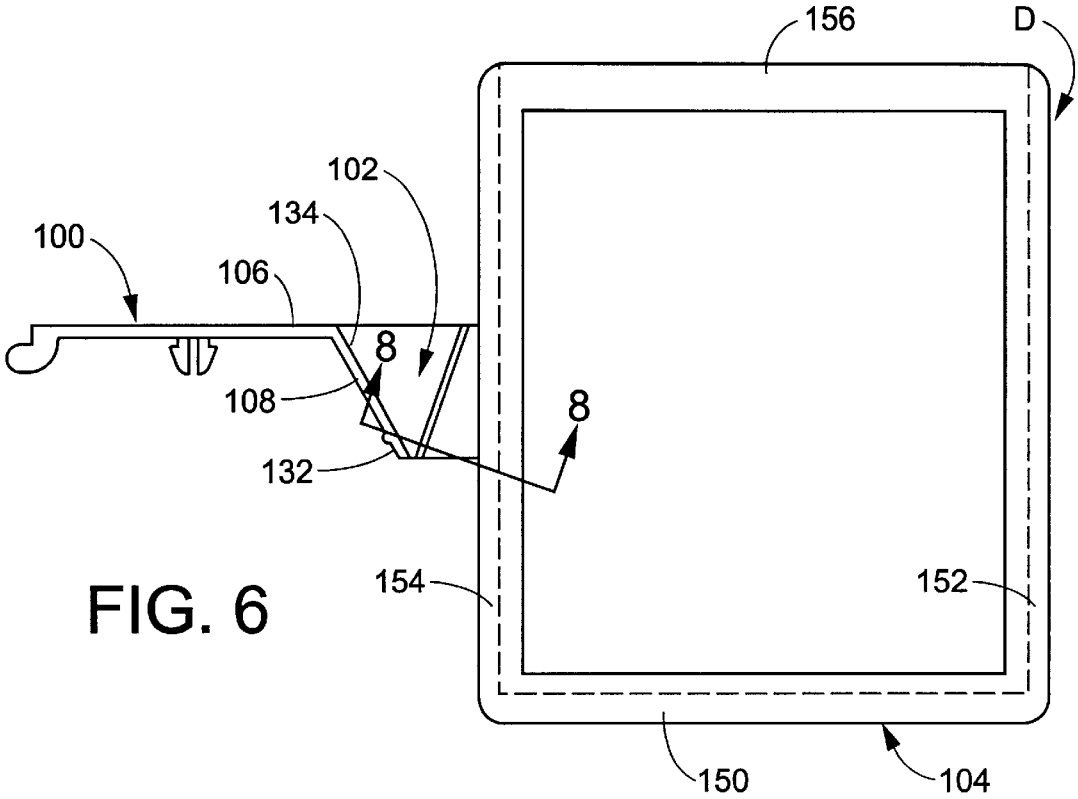
FIG. 6 is a side elevational view of a sign holder according to a second preferred embodiment of the present invention.
Figure 7:
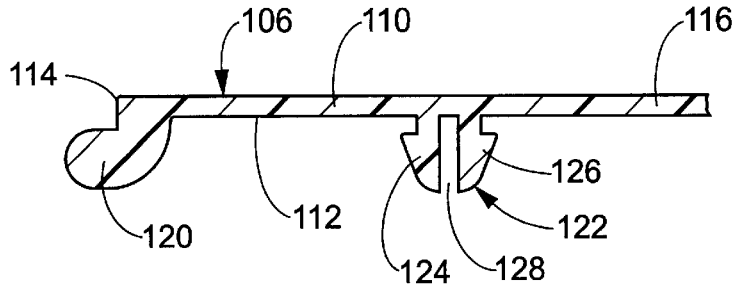
FIG. 7 is an enlarged cross-sectional view through a base portion of the sign holder of FIG. 6.
Figure 11:
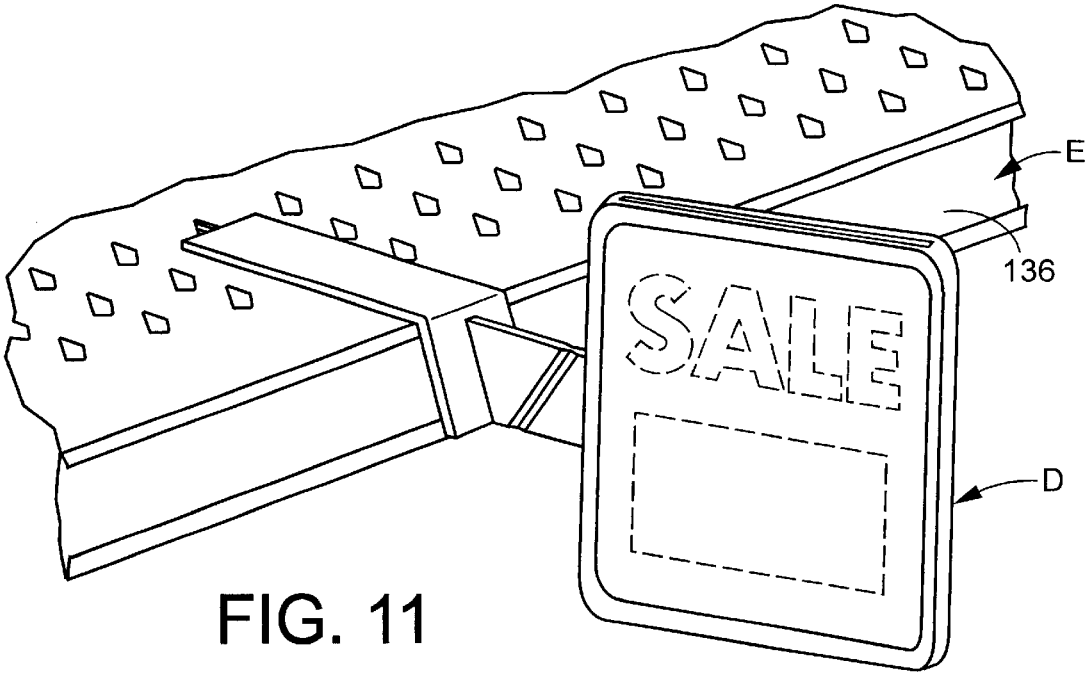
FIG. 11 is a perspective view of the sign holder of FIG. 6 as mount on a store shelf.

With reference now to FIG. 6, a sign holder D according to a second preferred embodiment of the present invention includes a base 100, a support member 102, and a holder body 104. These elements can, if desired, be of one piece and made from a conventional thermoplastic material. The base 100 has a first planar portion 106 and a second planar portion 108. With reference now to FIG. 7, the base first portion 106 comprises a top surface 110 and a bottom surface 112, as well as a first end 114 and a second end 116. Extending from the bottom surface 112 at the first end 114 is a finger 120. Protruding from the bottom surface 112, in a spaced manner from the finger 120, is a resilient fastener 122. In this embodiment, the resilient fastener comprises a first fastener half 124 which is spaced from a second fastener half 126 by a slot 128. With this construction, the resilient fastener can be readily snapped into an aperture in a mounting shelf E as is illustrated in FIG. 11. The fastener 122 resists removal of the sign holder D from the shelf E by jostling as a consumer may brush against the sign. The finger 120 and the resilient fastener 122 are so located in relation to each other that they can fit into most standard perforated shelves.

Figure 8:
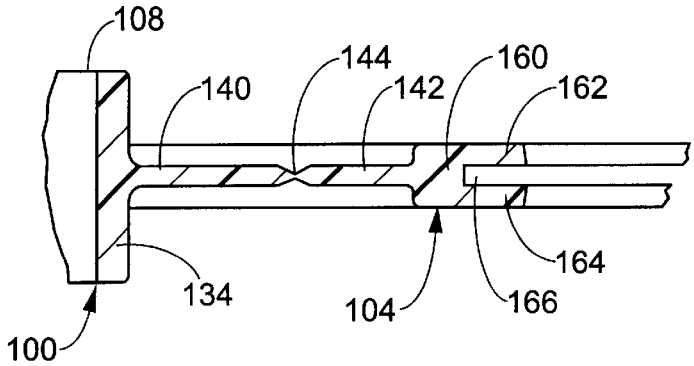
FIG. 8 is an enlarged cross-sectional view through a connecting portion of the sign holder of FIG. 6 along line 8—8.

The base second portion 108 includes a bottom surface 132 and a top surface 134. It is apparent that the base second portion 108 is angled in relation to the first portion 106 at an acute angle. The purpose for this is to accommodate a conventional C channel 136 which is located at the front edge of the shelf E, as illustrated in FIG. 11. Protruding from the top surface 134 of the base second portion 108 is the support member 102. With reference now to FIG. 8, the support member is substantially planar and includes a first end 140, at which it is mounted to the base, and a second end 142 at which it is mounted to the holder body 104. Located between the first and second ends is a living hinge 144.

Figure 10:
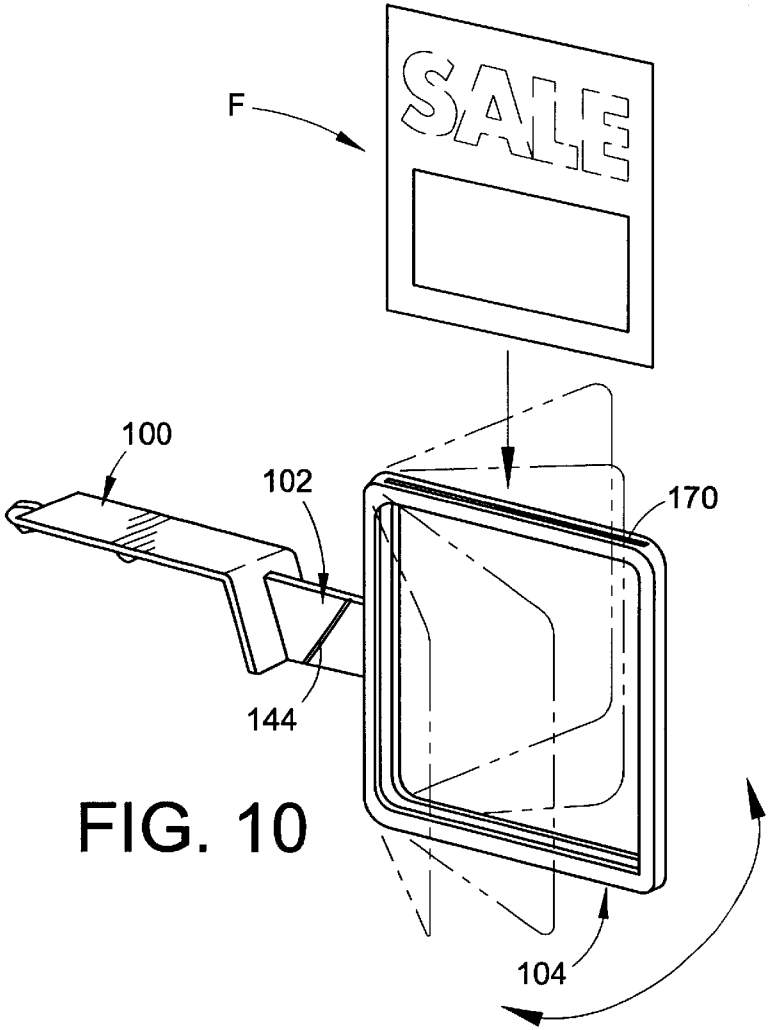
FIG. 10 is a perspective view of the sign holder of FIG. 6 illustrating its pivoting motion.

It is apparent from FIGS. 6 and 10 that the living hinge 144 is angled in relation to the vertical. The angle is an acute angle which is approximately reversed to the acute angle at which the base second portion 108 is oriented in relation to the base first portion. Due to the existence of the living hinge, and its orientation, the frame 104 is capable of swinging approximately 1800, as shown in FIG. 10. More particularly, the frame 104 is capable of swinging 900 in each direction from its normal orientation, perpendicular to the base 100. Due to the orientation of the living hinge, the frame 104 will swing back to its normal orientation when it is allowed to do so. The frame would be swung out of its normal orientation when it is brushed by a shopper walking down the aisle of a store. Thus the frame, and the connected portion of the support member 102, moves out of the way when bumped, but returns to its normal orientation thereafter.

Figure 9:
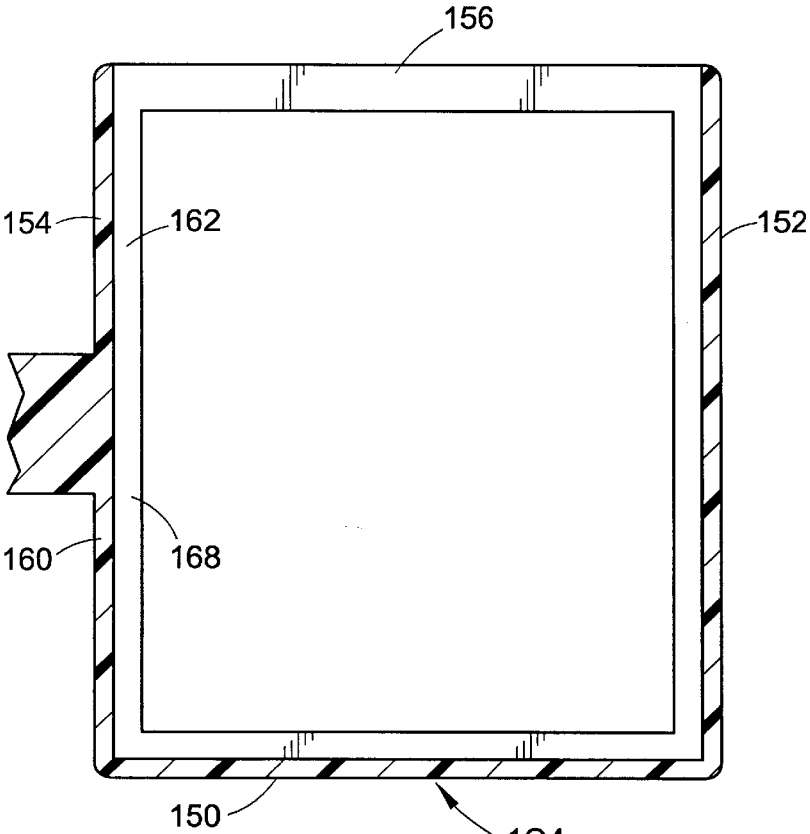
FIG. 9 is a cross-sectional view of a holder body of the sign holder FIG. 6.

With reference again to FIG. 6, the holder body 104 comprises a bottom wall 150, a first side wall 152, a second side wall 154, and a top wall 156. As is evident from FIG. 8, each of these walls, such as wall 154, is comprised of a base portion 160 and a pair of parallel, spaced flanges 162 and 164 connected thereto. Defined between the flanges 162 and 164 is a slot 166. As is evident from FIG. 9, a frame-like socket 168 is thus defined in the holder body 104. The top wall 156 has a different construction. More particularly, it only includes the pair of flanges 162 and 164. Defined between these two is a slot 170 through which a sign F can be inserted or removed from the holder body 104. The socket 168 can be sized so as to hold signs made of a material having a thickness of, for example, 0.020". It is evident that the socket can be constructed to accommodate signs of any desired thickness. The maximum size of the signs which can be held in the holder body 104 is entirely dependent upon the size of the holder body.

Figure 12:
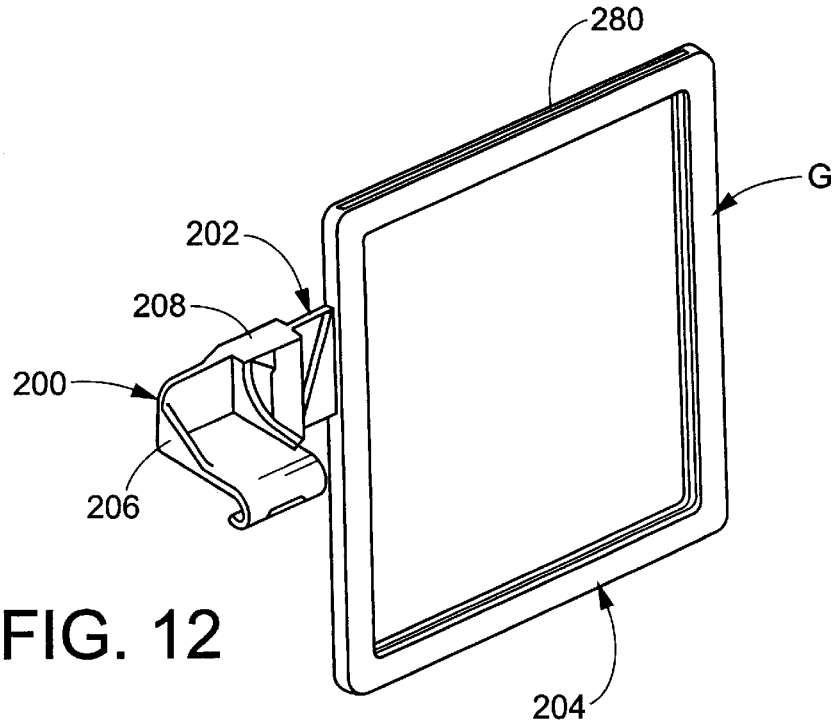
FIG. 12 is a perspective view of a sign holder adapted for use on peg hook according to a third preferred embodiment of the present invention.
Figure 14:
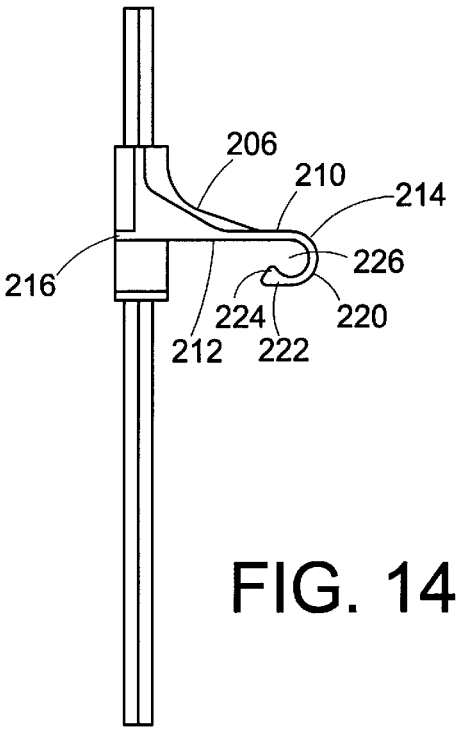
FIG. 14 is an end elevational view of the sign holder of FIG. 12.
Figure 18:
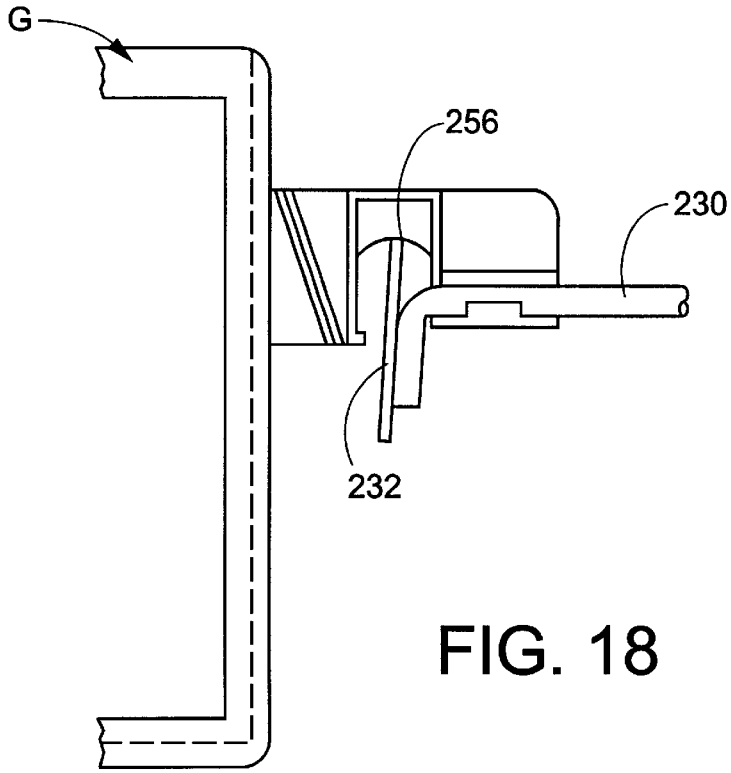
FIG. 18 is a perspective view of a third step of mounting the sign holder to a peg hook.
Figure 19:
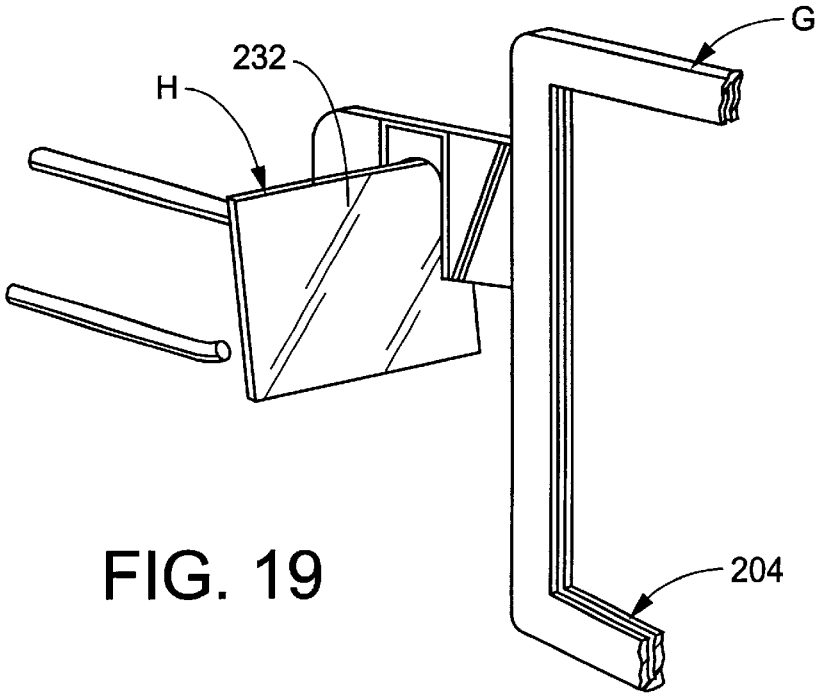
FIG. 19 is a perspective view of the sign holder in its final mounting position on the peg hook.

With reference now to FIG. 12, a peg hook sign holder G according to a third preferred embodiment of the present invention is there illustrated. This sign holder includes a base 200, a support member 202, and a holder body 204. The base 200 includes a first portion 206 and a second portion 208. With reference now also to FIG. 14, the base first portion includes a top surface 210 and a bottom surface 212, as well as a first end 214 and a second end 216. Projecting downwardly from the first end 214 is a clip portion 220. The clip portion includes a centrally positioned finger 222. Located on the finger is a protrusion 224. The clip portion 220 cooperates with a wall of the base first portion to form a socket 226. With reference now to FIG. 18, the socket accommodates a support leg 230 of a peg hook H (FIG. 19). The support leg has mounted on its distal end a label plate 232.

Figure 15:
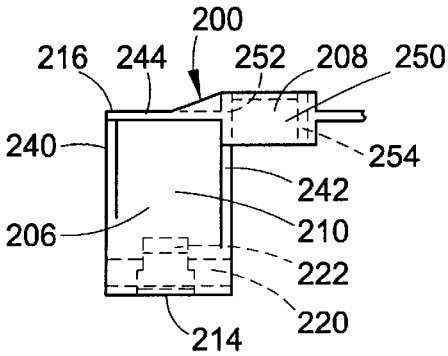
FIG. 15 is a top plan view of a mounting portion of the sign holder of FIG. 12.

With reference now to FIG. 15, extending from the top surface 210 of the base first portion 206 are a pair of spaced side reinforcing walls 240 and 242 which are joined to opposed ends of a rear reinforcing wall 244. The base second portion 208 comprises a top wall 250 and a pair of opposed side walls 252 and 254. Depending from a bottom surface of the top wall 250 is a bridge 256, which is best seen in FIG. 13.

The support member 202 includes a first end 260 that is secured to the base 200 and a second end 262 which is secured to the holder body 204. Defined between the two ends is a living hinge 264 which extends in an angled manner in relation to a vertical axis as is evident from FIG. 13. The living hinge allows the holder body 204 to pivot in relationship to the base 200, as in the embodiment of FIGS. 6–11.

Figure 13:
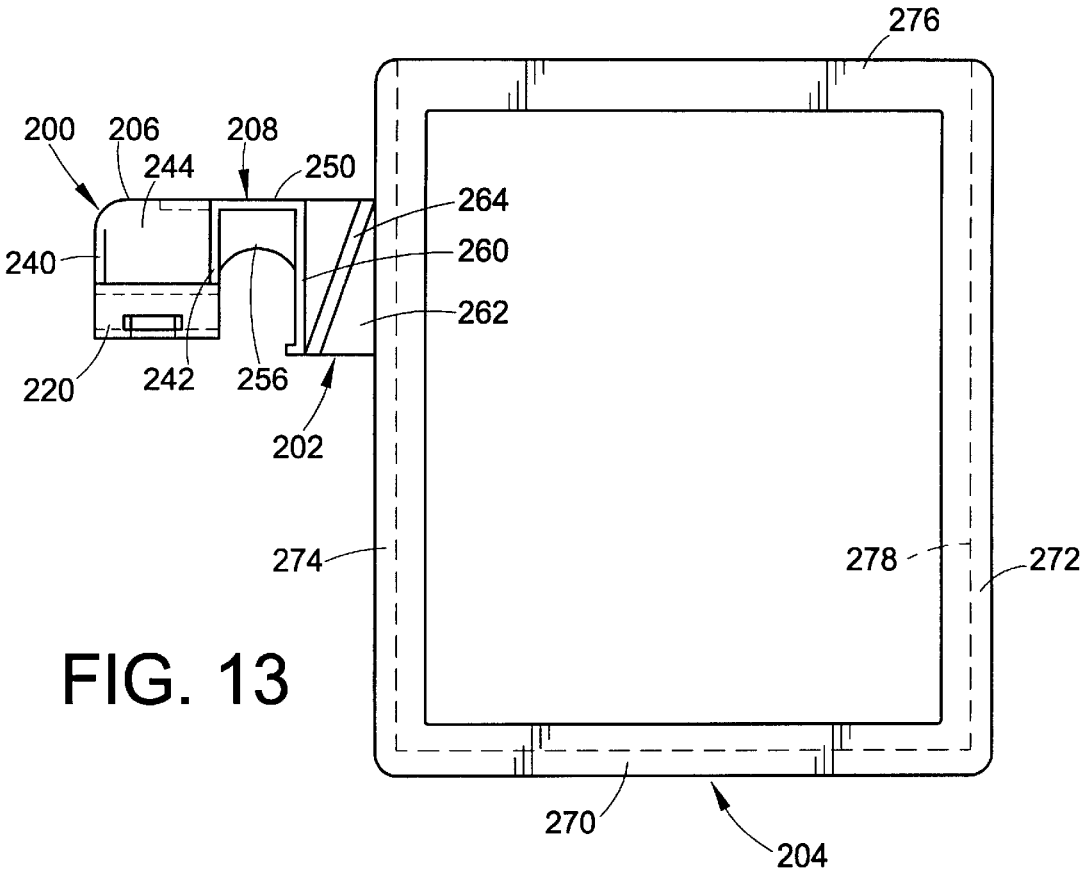
FIG. 13 is a side elevational view of the sign holder of FIG. 12.

With continued reference to FIG. 13, the holder body 204 includes a bottom wall 270, a first side wall 272, a second side wall 274, as well as a top wall 276. As in the embodiment of FIGS. 6–11, a socket 278 is defined between the walls for accommodating a suitable sign. As best illustrated in FIG. 12, a slot 280 is defined between the two halves of the top wall 276 in order to allow a sign to be inserted into the socket 278 or removed therefrom.

Figure 16:
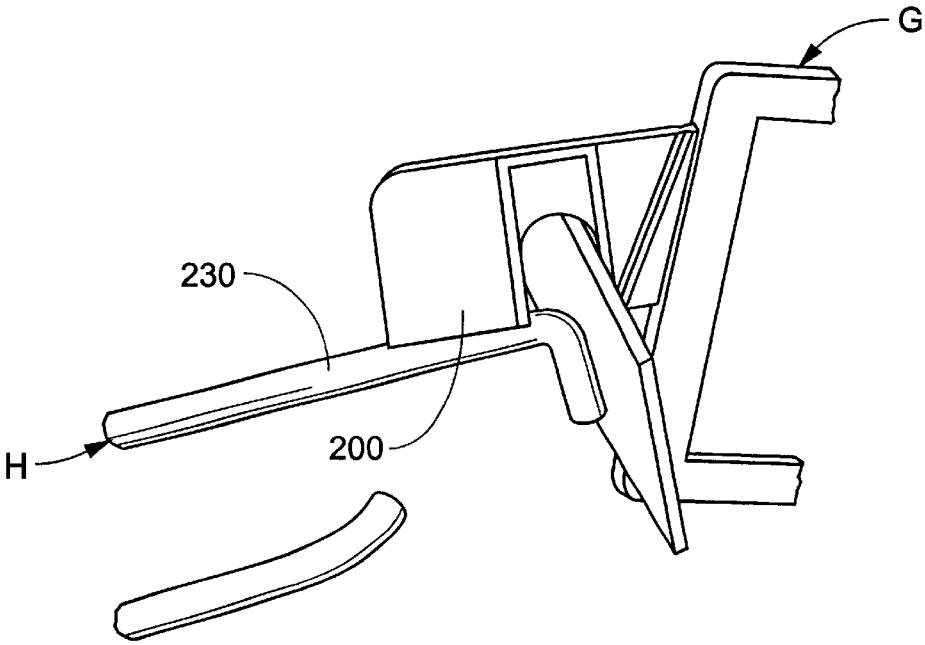
FIG. 16 is a perspective view of a first step of mounting the sign holder of FIG. 12 to a peg hook.
Figure 17:
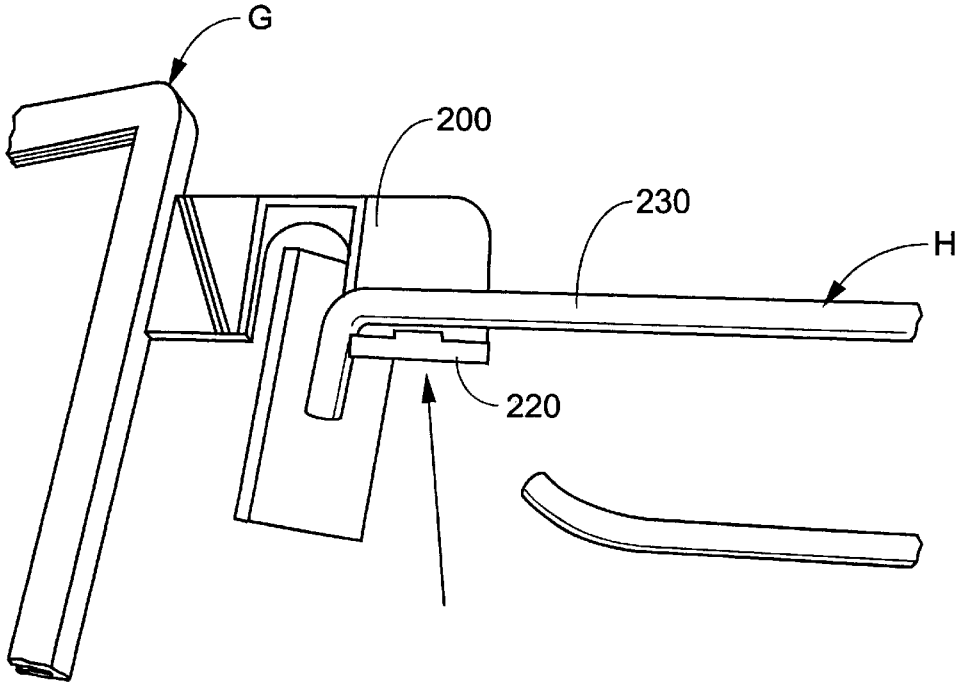
FIG. 17 is a perspective view of a second step of mounting the sign holder to the peg hook.

With reference now to FIGS. 16–19 the method for installation of the sign holder G on the peg hook H is there illustrated. First, as is shown in FIG. 16, the sign holder G is placed over the support leg 230 of the peg hook H in such a way that the support leg adjoins a protrusion 224 in the clip portion 220 of the base 200. Then, as is illustrated in FIG. 17, the clip 220 is pushed over the support leg 230 until it snaps into place. As is shown in FIG. 18, the sign holder G is then rotated into position such that the bridge 256 of the base second portion 208 is seated on one side of the label plate 232. The final position of the sign holder G in relation to the label plate 232 is shown in FIG. 19. It is apparent from FIG. 19 that the label plate 232 remains visible to consumers while the holder body 204 prominently calls attention to the products held on the peg hook H.

While the holder bodies 104 of FIGS. 6–11 and 204 of FIGS. 12–19 are illustrated as being approximately rectangular, it should be appreciated that other geometric shapes could also be employed for the holder body. For example, the holder body could be formed as an inverted triangle, a hexagon or have any other desired number of wall sections. Thus polygons of all types could be used as the wall sections of the frame-like holder body. In addition, the holder body could also be circular, elliptical, or have any desired curvature for one or more wall sections of the frame-like holder body.

In addition, while FIGS. 6–19 illustrate holder bodies which enclose all four sides of an associated sign, it should be evident that holder bodies which surround two or more sides of a sign could be similarly employed. For example, an L-shaped holder body or a U-shaped holder body with no top wall could be used instead of the rectangular frame-like holder bodies illustrated in FIGS. 6–19. All that is necessary is that the sign held in the frame-like holder body not be readily detachable by consumer contact as, for example, a shopper brushes against the sign holder while walking down a store aisle.

While two specific types of bases were illustrated in FIGS. 6–19, it should be appreciated that other types of bases could also be employed for securing the sign holder to other types of retail displays. More specifically, FIGS. 6–11 illustrated a base for selectively mounting the sign holder on a conventional shelf and FIGS. 12–19 illustrated a base for mounting the sign holder to a peg hook. It should be appreciated that other types of bases may be employed to mount the sign holder to a variety of other types of known retail displays.

The invention has been described with reference to several preferred embodiments. Obviously, alterations and modifications will occur to others upon a reading and understanding of the specification. It is intended to include all such modifications and alterations insofar as they come within the scope of the appended claims or the equivalents thereof.

Having thus described the present invention, it is now claimed:

1. A sign holder assembly, comprising:

a base, said base including a top surface and a bottom surface, a first end and a second end;

a connector member extending away from said bottom surface of said base for engaging a wall surface adjacent a hole in an associated display shelf to hold said base to the associated display shelf;

a support member connected to said base, said support member comprising a first end and a second end, said support member being connected to said base at said first end; and, a holder body for selectively accommodating an associated sign, said second end of said support member being connected to said holder body, said holder body comprising a bottom wall, a first side wall and a second side wall, said first and second side walls being spaced apart and being connected to said bottom wall, said bottom wall and said side walls cooperating to form a socket for selectively accommodating an associated sign.

2. The sign holder assembly of claim 1 wherein said base comprises a first portion located in a first plane and a second portion located in a second plane which is oriented at an angle to said first plane.

3. The sign holder assembly of claim 1 wherein said support member comprises a living hinge positioned between said first and second ends thereof, said holder body being pivotable in relation to said base via said hinge between a first orientation approximately parallel to a longitudinal axis of said base and a second orientation approximately normal to said longitudinal axis of said base.

4. A sign holder assembly, comprising:

a base, said base including a top surface and a bottom surface, a first end and a second end;

a support member connected to said base, said support member comprising a first end and a second end, said support member being connected to said base at said first end;

a holder body for selectively accommodating an associated sign, said second end of said support member being connected to said holder body, said holder body comprising a bottom wall, a first side wall and a second side wall, said first and second side walls being spaced apart and being connected to said bottom wall, said bottom wall and said side walls cooperating to form a socket for selectively accommodating an associated sign; and, wherein said base further comprises a resilient fastener secured to said bottom surface of said base, said resilient fastener engaging a wall surface adjacent a hole in an associated display rack.

5. The sign holder assembly of claim 4 wherein said base further comprises a finger extending from said bottom surface of said base, said finger being spaced from said resilient fastener and engaging a wall surface adjacent a hole in the associated display rack.

6. The sign holder assembly of claim 1, wherein said holder body further comprises a top wall and a slot extending longitudinally along said top wall, said slot communicating with said socket to allow the associated sign to be selectively positioned within said holder body.

7. The sign holder assembly of claim 1, wherein said base, said support member and said holder body are of one piece and are made of a plastic material.

8. The sign holder assembly of claim 1, wherein said base comprises a clip for mounting said base on an associated peg hook.

9. A sign holder assembly, comprising:

a base, said base having a longitudinal axis, and comprising a first portion and a second portion, wherein said second portion extends away from a longitudinal axis of said first portion;

a connecting member extending from said second portion of said base, said connecting member comprising a living hinge;

a holder body secured to said connecting member, said holder body comprising:

a bottom wall having a first end and a second end, a first side wall connected to said bottom wall first end, and a second side wall connected to said bottom wall second end, wherein said bottom wall and said first and second side walls cooperate to form a socket for accommodating an associated sign; and wherein said base further comprises a resilient fastener secured to a bottom surface of said base first portion, said resilient fastener engaging a surface of an associated display device.

10. The sign holder assembly of claim 9 wherein said base further comprises a finger extending from said bottom surface of said base first portion, said finger being spaced from said resilient fastener and engaging a wall surface adjacent a hole in the associated display device.

11. The sign holder assembly of claim 10 wherein said resilient fastener and said finger are aligned with each other along said longitudinal axis of said base first portion to engage wall surfaces of spaced holes aligned with each other in the associated display device.

12. The sign holder assembly of claim 9, wherein said base, said connecting member and said holder body are of one piece and are made of a plastic material.

13. The sign holder of claim 9 wherein said holder body further comprises a top wall and a slot extending longitudinally along said top wall, said slot communicating with said socket to allow a sign to be selectively held in said holder.

14. A sign holder assembly, comprising:

a base, said base including a first portion and a second portion;

a holder body, wherein said holder body is frame-like and comprises at least one side wall;

a connecting member extending between said base and said holder body;

wherein said at least one side wall of said holder body comprises a pair of spaced flanges connected to a base wall, said pair of spaced flanges extending approximately parallel to each other and forming a sign edge-receiving slot between them for selectively receiving at least one edge of an associated sign; and, a hinge, said hinge being located on the connecting member, wherein said hinge is oriented at a first acute angle in relation to a vertical axis.

15. The sign holder assembly of claim 14 wherein said base, said connecting member and said holder body are of one piece.

16. The sign holder assembly of claim 14 wherein said base further comprises at least one resilient fastener extending from a bottom surface of said base, said at least one resilient fastener engaging a portion of an associated display device to hold said base to the associated display device.

17. The sign holder assembly of claim 14 wherein said holder body further comprises a bottom wall connected to said at least one side wall.

18. The sign holder assembly of claim 14 wherein said base comprises a first portion located in a first plane and a second portion located in a second plane which is oriented at an angle to said first plane.

19. The sign holder assembly of claim 18 wherein said base second portion is oriented at a second acute angle in relation to said base first portion and wherein said first acute angle of said hinge and said second acute angle of said base second portion are approximately reversed in relation to each other.

* * * * *